US010321792B2

(12) United States Patent
Kennedy

(10) Patent No.: US 10,321,792 B2
(45) Date of Patent: Jun. 18, 2019

(54) SYSTEMS AND METHODS FOR PRODUCT DISPENSING

(71) Applicant: David Kennedy, Christianburg, VA (US)

(72) Inventor: David Kennedy, Christianburg, VA (US)

( * ) Notice: Subject to any disclaimer, the term of this patent is extended or adjusted under 35 U.S.C. 154(b) by 245 days.

(21) Appl. No.: 15/208,415

(22) Filed: Jul. 12, 2016

(65) Prior Publication Data

US 2018/0014701 A1 Jan. 18, 2018

(51) Int. Cl.

*A47K 10/32* (2006.01)
*A47K 10/38* (2006.01)
*A47K 10/42* (2006.01)

(52) U.S. Cl.

CPC ..... *A47K 10/32* (2013.01); *A47K 10/3836* (2013.01); *A47K 10/426* (2013.01); *A47K 2010/326* (2013.01); *A47K 2010/3233* (2013.01); *A47K 2010/3266* (2013.01); *A47K 2010/389* (2013.01)

(58) Field of Classification Search

CPC ..... A47K 2010/3233; A47K 2010/389
See application file for complete search history.

(56) References Cited

U.S. PATENT DOCUMENTS

| | | | | |
|---|---|---|---|---|
| 5,311,986 | A | 5/1994 | Putz | |
| 2007/0095769 | A1* | 5/2007 | Jenkins | A47K 10/38 211/119.009 |
| 2007/0119858 | A1* | 5/2007 | Ayoub | A47K 10/421 221/2 |
| 2007/0181594 | A1* | 8/2007 | Thompson | A47K 10/40 221/190 |
| 2008/0001019 | A1* | 1/2008 | Brown | A47K 10/3836 242/597.8 |
| 2013/0264925 | A1* | 10/2013 | Kling | A47G 1/175 312/293.3 |
| 2014/0166803 | A1* | 6/2014 | Choe | A47K 10/38 242/590 |
| 2017/0202410 | A1* | 7/2017 | Epperley | A47K 10/426 |

* cited by examiner

*Primary Examiner* — William E Dondero
(74) *Attorney, Agent, or Firm* — Foley & Lardner LLP

(57) ABSTRACT

A system for dispensing toilet paper and wipes in a bathroom includes a frame configured to be coupled to a wall of a bathroom via a fastener connection with the wall, a product arm configured to receive toilet paper and facilitate dispensing of the toilet paper, the product arm coupled to the frame, and an auxiliary dispenser configured to dispense wipes, the auxiliary dispenser coupled to the frame where the auxiliary dispenser is operable between an open position and a closed position, where the wipes can be loaded into a receiving bay when the auxiliary dispenser is in the open position, and where the wipes can be dispensed from the receiving bay by a user when the auxiliary dispenser is in the closed position.

20 Claims, 6 Drawing Sheets

SYSTEMS AND METHODS FOR PRODUCT DISPENSING

TECHNICAL FIELD

The present disclosure relates to the field of product dispensing. More specifically, the present disclosure relates to a system and method for holding and dispensing rolled products while simultaneously providing the capability to dispense a secondary product.

BACKGROUND

It has become quite common for products to be stored in a rolled form. Rolled products are advantageous for some applications because they take up a minimal amount of space and are easy to dispense. In some applications, it is desirable to have quick access to two different products. For example, in a bathroom it is often desired to have quick access to toilet tissue, wipes, personal hygiene products, and other products.

Typically, rolled products are stored in a holder. The holder may allow the rolled product to rotate while maintaining the rolled product in a location. In this way, the rolled product can be easily dispensed. For example, toilet paper dispensers are typically mounted to a wall and allow a roll of toilet paper to be dispensed therefrom. However, typical toilet paper dispensers lack the capability to dispense an additional product and instead only dispense toilet paper. It is common for user of a toilet to use a mobile device. However, when the user wishes to access rolled products the mobile device must be stowed. Typical toilet paper dispensers lack the capability to receive the mobile device while retaining the mobile device when the toilet paper is dispensed from the toilet paper dispensers.

Accordingly, it is desirable to develop a holder for rolled products that provides the ability to dispense rolled products and an additional product while retaining a mobile device. In particular, it is desirable to develop a toilet paper dispenser that provides the ability to dispense toilet paper and an additional product while retaining a mobile device. For example, it would be desirable to utilize a toilet paper dispenser to quickly dispense both toilet paper and additional bathroom products (e.g., wet wipes, soaps, sprays, etc.).

SUMMARY

One embodiment relates to a rolled product dispenser. The rolled product dispenser includes a frame configured to be coupled to a wall, a product arm configured to support and retain a rolled product for dispensing, the product arm coupled to the frame, an auxiliary dispenser configured to dispense a secondary product, the auxiliary dispenser coupled to the frame, and a channel configured to receive a mobile device of a user on a bottom surface of the channel, the channel integrated within the frame.

Another embodiment is related to a system for dispensing toilet paper and wipes in a bathroom. The system includes a frame configured to be coupled to a wall of a bathroom via a fastener connection with the wall, a product arm configured to receive toilet paper and facilitate dispensing of the toilet paper, the product arm coupled to the frame, and an auxiliary dispenser configured to dispense wipes, the auxiliary dispenser coupled to the frame where the auxiliary dispenser is operable between an open position and a closed position, where the wipes can be loaded into a receiving bay when the auxiliary dispenser is in the open position, and where the wipes can be dispensed from the receiving bay by a user when the auxiliary dispenser is in the closed position.

Another embodiment is related to a method for manufacturing a rolled product dispenser. The method includes constructing a frame, forming a receiving channel in the frame, the receiving channel configured to receive a mobile device, coupling a product arm to the frame, the product arm configured to receive a rolled product, forming a receiving bay in the frame, inserting an auxiliary dispenser into the receiving bay, the auxiliary dispenser configured to dispense a secondary product, and inserting a light into the frame, the light configured to illuminate the rolled product.

Another embodiment relates to a method for receiving and dispensing rolled product and secondary product to a user. The method includes receiving rolled product on a product arm coupled to a frame of a rolled product dispensing system, loading secondary product into an auxiliary dispenser in an open position, biasing the auxiliary dispenser to a closed position, placing a mobile device of a user in a channel of the frame of the rolled product dispensing system, illuminating the rolled product through the use of a light coupled to the frame, dispensing the rolled product from the product arm, and dispensing the secondary product from an opening in the auxiliary dispenser.

DETAILED DESCRIPTION

Figure 1:
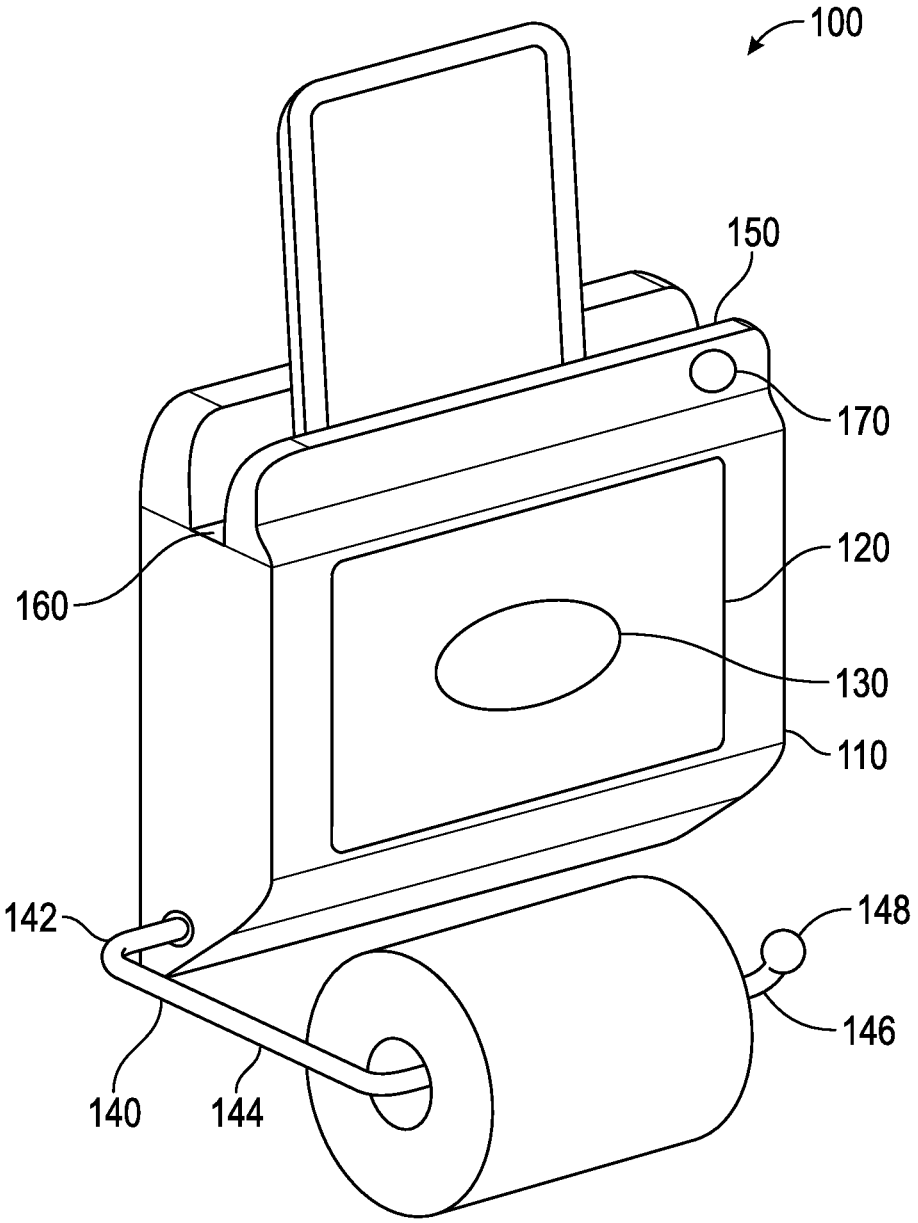
FIG. 1 is a front perspective view of a rolled product dispenser, according to an exemplary embodiment.

In the following detailed description, reference is made to the accompanying drawings, which form a part thereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

Referring to the Figures generally, various embodiments disclosed herein relate to a rolled product dispenser for dispensing a rolled product (e.g., toilet paper, toilet tissue, paper towels, etc.) and a secondary product (e.g., wipes, wet wipes, personal hygiene products, etc.). The rolled product dispenser is configured to dispense rolled products. The rolled product dispenser may include an auxiliary dispenser mounted on the frame of the rolled product dispenser. The auxiliary dispenser may dispense the secondary product through an opening in the auxiliary dispenser. The auxiliary dispenser may be opened so that the secondary product can be loaded into a receiving bay. The rolled product dispenser may also include a product arm coupled to the frame for dispensing the rolled product. The product arm may be selectively removable from the frame.

The rolled product dispenser may also include a retaining channel. The retaining channel may receive a mobile device of a user such that the mobile device is secured in the retaining channel. The retaining channel may include a bottom surface configured to interface with the mobile device. The bottom surface may assist the retaining channel in preventing unintended movement of the mobile device in the retaining channel. The rolled product dispenser may also include a light. The light may illuminate portions of the rolled product device or the user. These and other features of the present disclosure are described more fully herein.

Figure 2:
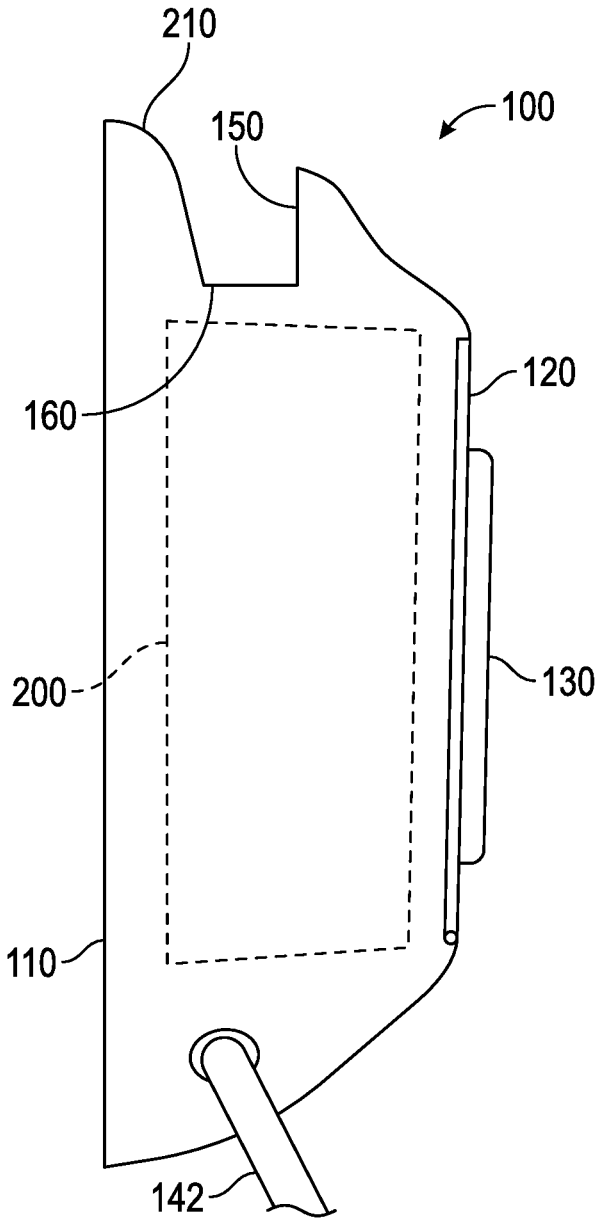
FIG. 2 is a side view of the rolled product dispenser shown in FIG. 1.

Referring now to FIGS. 1-2, a device (e.g., mechanism, system, etc.), shown as rolled product dispenser 100, is shown according to an exemplary embodiment. As described herein, rolled product dispenser 100 is configured to dispense a personal hygiene product, shown as toilet paper. However, rolled product dispenser 100 may also dispense other rolled products. Rolled product dispenser 100 includes a frame (e.g., base, mount, panel, etc.), shown as frame 110. Frame 110 is configured to secure rolled product dispenser 100 to a mounting surface (e.g., wall, panel, stud, shelf, tile, etc.). Rolled product dispenser 100 also includes a dispenser, shown as auxiliary dispenser 120. Auxiliary dispenser 120 is coupled to frame 110 and configured to receive a secondary personal hygiene product. In some embodiments, auxiliary dispenser 120 is configured to receive wipes (e.g., wet wipes, baby wipes, etc.). Auxiliary dispenser 120 is operable between a closed position (e.g., vertical position), where the secondary product is dispensed from auxiliary dispenser 120, and an open position, where the secondary product is loaded into auxiliary dispenser 120. Following these embodiments, rolled product dispenser 100 may be used to simultaneously or sequentially dispense toilet paper and wipes. Auxiliary dispenser 120 includes an opening (e.g., hole, gap, etc.), shown as opening 130. Opening 130 may allow a user to remove wipes from auxiliary dispenser 120 easily while securely retaining the wipes (e.g., wipes package, etc.). Opening 130 is substantially parallel to the mounting surface when auxiliary dispenser 120 is in the closed position. In some examples, opening 130 is vertically oriented when auxiliary dispenser 120 is in the closed position.

Rolled product dispenser 100 also includes a rolled product holder (e.g., bar, hook, prong, etc.), shown as product arm 140. Product arm 140 is configured to receive and support a rolled product and to maintain a position of the rolled product in relation to rolled product dispenser 100. Product arm 140 includes a first portion, shown as adaptor portion 142, a second portion, shown as spacing portion 144, and a third portion, shown as retaining portion 146. Adaptor portion 142 is configured to couple product arm 140 to frame 110. Spacing portion 144 is designed to establish a target spacing between frame 110 and the rolled product that is to be received by product arm 140. Retaining portion 146 is configured to provide a securing force on the rolled product such that the rolled product is not unintentionally removed from product arm 140. Product arm 140 may be mounted with friction bushings to allow controlled movement of product arm 140 toward the user or to accommodate different sizes of rolled products.

Rolled product dispenser 100 also includes a channel (e.g., canal, slot, tray, etc.), shown as retaining channel 150. Retaining channel 150 is intended to receive various items from a user such as a mobile device (e.g., phone, smart phone, tablet, etc.) and other personal items (e.g., keys, purses, wallets, etc.). Retaining channel 150 includes a surface (e.g., face, etc.), shown as bottom surface 160. Bottom surface 160 is configured to provide a retaining force on any items placed in retaining channel 150. For example, bottom surface 160 may include a gel pad or similar material intended to prevent a user's phone from slipping out of retaining channel 150 if rolled product dispenser 100 is bumped. According to various embodiments, rolled product dispenser 100 further includes an illumination source (e.g., light emitting diode (LED), lighting element, light source, bulb, etc.), shown as light 170. Light 170 is configured to illuminate portions of product arm 140 such that the user can see a rolled product in situations where lighting is compromised. However, in some embodiments, rolled product dispenser 100 does not include light 170.

As shown in FIG. 2, rolled product dispenser 100 further includes a compartment (e.g., zone, void, etc.), shown as receiving bay 200. Receiving bay 200 may be sized according to the size of auxiliary dispenser 120. For example, receiving bay 200 may be sized to receive a box of wipes. In an exemplary operation, receiving bay 200 is accessed by a user moving auxiliary dispenser 120 from the closed position to the open position. In the open position, the user may load secondary product (e.g., wipes, etc.) into receiving bay 200 and thereby into auxiliary dispenser 120. In this way, auxiliary dispenser 120 can be loaded with secondary product. According to an exemplary embodiment, auxiliary dispenser 120 is accessed by articulating a lid of auxiliary dispenser 120. Similarly, the secondary product can be dispensed (e.g., extracted, etc.) from receiving bay 200 when auxiliary dispenser 120 is in the closed position.

According to various embodiments, frame 110 is constructed at least primarily from a plastic material. For example, in some embodiments frame 110 is constructed from polymer blend or alloy. Frame 110 may be colored. For example, frame 110 may be colored to match surrounding fixtures (e.g., toilets, etc.) or surfaces (e.g., walls). Similarly, frame 110 may be painted. For example, if frame 110 is constructed from plastic, paint for plastic may be used. Similarly, frame 110 may be constructed from other materials such as aluminum, stainless steel, and porcelain. In some applications, frame 110 is constructed from multiple materials. For example, frame 110 may have a plastic or polymer core surrounded by a metallic shell. In this way, frame 110 may have the desirable characteristics of metal while having the desirable characteristics the plastic or polymer. Further, frame 110 may be covered in an applique configured to apply a design to frame 110. The design may match a design of an environment where rolled product dispenser 100 will be installed in.

In some applications, frame 110 is subjected to a finishing process. For example, frame 110 may be brushed, polished, chromed, plated, anodized, and coated. In some examples, frame 110 resembles brushed nickel, antique brass, and gold plate. Frame 110 may mount rolled product dispenser 100 to a wall. For example, frame 110 may be secured to the wall through the use of fasteners (e.g., screws, bolts, etc.) in at least one of frame 110 and the wall. The interaction between a fastener in frame 110 and a fastener in the wall may be referred to as a fastener connection and/or a hardmount. In other applications, frame 110 is secured to the wall using adhesive strips. According to an exemplary embodiment, frame 110 includes adhesive strips mounted on frame 110 and frame 110 may be mounted to the wall through the use of a combination of the fasteners and/or fastener connections and the adhesive strips.

Auxiliary dispenser 120 may be used to provide additional products to a user. For example, auxiliary dispenser 120 may provide a user with medicated wipes. Similarly, auxiliary dispenser 120 may provide a user with washcloths, tissues, disposable toilet seat covers, soaps, sprays, lotions, creams, and other personal hygiene products. Opening 130 may be of various shapes and sizes depending on auxiliary dispenser 120. Similarly, opening 130 may also be configured to provide a desired effect on a secondary product. For example, opening 130 may be serrated such that removal of a section of a product from auxiliary dispenser 120 may be easier. Similarly, opening 130 may be covered by moveable flaps such that products from within auxiliary dispenser 120 are covered and/or secured.

In some alternative embodiments, auxiliary dispenser 120 may provide the user with a personal hygiene product such as a tampon, diaper (e.g., baby, adult, etc.), or catheter. In other alternative applications, auxiliary dispenser 120 is intended to receive waste from the user (e.g., wrappers, paper, etc.) and serve as a waste bin. In another alternative example, auxiliary dispenser 120 is configured to receive biological waste (e.g., needles, etc.) in a locked container. In still other alternative applications, auxiliary dispenser 120 is replaced with advertising content or a display screen configured to provide visual content to the user. In an alternative embodiment, opening 130 is configured to be covered by a lockable door. According to this embodiment, the lockable door covering opening 130 is moveable if a user performs a target action. For example, the lockable door may be opened by a user after paying for a product from auxiliary dispenser 120 (e.g., via depositing funds, dipping a credit card, etc.). Similarly, the lockable door may be opened by a user through the use of a key (e.g., proximity based key, tumbler based key, etc.). In one alternative example, the lockable door may be opened after the user completes an action on a mobile application, accessible through a mobile device of the user. The action may be paying for use of a product from auxiliary dispenser 120. The lockable door of auxiliary dispenser 120 may be configured to secure extra rolled products for use in rolled product dispenser 100. Similarly, auxiliary dispenser 120 may be lockable in the open position or the closed position. For example, auxiliary dispenser 120 may be locked in the closed position by a key being turned in a lock on auxiliary dispenser 120.

Product arm 140 is configured to receive and facilitate dispensing a product. In many applications, product arm 140 is round in shape (e.g., in cross-section). According to various embodiments, product arm 140 is constructed from aluminum. However, in other applications product arm 140 may be constructed from stainless steel, plastic, a polymer blend, an alloy, or other suitable material such that the rolled product dispenser 100 may be tailored for a target application. Depending on the application, product arm 140 may be painted, coated, finished, or otherwise treated like frame 110. For example, product arm 140 may have a brushed nickel finish, an antique brass finish, or a gold plate finish. Similarly, product arm 140 may be constructed from multiple materials. For example, product arm 140 may have a plastic or polymer core surrounded by a metallic shell. In this way, product arm 140 may have the desirable characteristics of metal while having the desirable characteristics the plastic or polymer. In an exemplary embodiment, frame 110 is constructed from a plastic material and product arm 140 is constructed from aluminum. Further, product arm 140 may be covered in an applique configured to apply a design to product arm 140. The design may match a design of an environment where rolled product dispenser 100 will be installed in.

In some alternative embodiments, product arm 140 incorporates a light such to provide illumination. For example, a light on product arm 140 may illuminate portions of rolled product dispenser 100 such as auxiliary dispenser 120, may illuminate a rolled product received by product arm 140, or may illuminate a portion of an area surrounding rolled product dispenser 100 (e.g., the floor, a toilet, etc.). According to various embodiments, product arm 140 is substantially C-shaped.

According to various embodiments, adaptor portion 142 is configured to be inserted into frame 110. For example, adaptor portion 142 may be threaded and frame 110 may include a threaded hole such that adaptor portion 142 may be threaded into frame 110. Similarly, adaptor portion 142 may include a threaded nut configured to engage a threaded portion of frame 110 to secure product arm 140 to frame 110. Instead of utilizing a threaded connection, adaptor portion 142 may utilize integral attachment features (e.g., snap-fit features, etc.) to couple frame 110. Adaptor portion 142 may also be adhesively affixed to frame 110 through the use of an adhesive such as glue, rubber cement, calk, and other suitable adhesives. Alternatively, adaptor portion 142 may be permanently affixed to frame 110 through a material fusion process such as welding. In some embodiments, product arm 140 is selectively removable (e.g., detachable, etc.). For example, in an application (e.g., installation, etc.) where a rolled product dispenser is present, the user may wish to utilize the existing rolled product dispenser. In this situation, the user detaches product arm 140 so that rolled product dispenser 100 can be utilized along with the existing rolled product dispenser. However, in other applications where an existing rolled product dispenser is present, product arm 140 may not be removed. Instead, both product arm 140 and the existing rolled product dispenser may both be used or the existing rolled product dispenser may be removed. Such flexibility allows rolled product dispenser 100 to be easily retrofit into various applications.

Spacing portion 144 is defined by a length. The length of spacing portion 144 determines the distance between adaptor portion 142 and retaining portion 146. Accordingly, the length of spacing portion 144 determines the rolled products which may be received by product arm 140. For example, the length of spacing portion 144 determines a maximum diameter of rolled products that may be received by product arm 140. Accordingly, the length of product arm 140 may be varied such that rolled product dispenser 100 is tailored for a target application. Spacing portion 144 may be integral with adaptor portion 142 and retaining portion 146 or may be affixed to either or both of adaptor portion 142 and retaining portion 146. According to various embodiments, the angle adaptor portion 142 and spacing portion 144 and the angle between retaining portion 146 and spacing portion 144 are substantially ninety degrees. However, depending on the application, these angles may be varied. For instance, these angles may be manipulated to place the rolled product in a desired location. Similarly, while spacing portion 144 is shown as substantially straight, it is understood that spacing portion 144 may be curved or otherwise shaped such that rolled product dispenser 100 is tailored for a target application.

Retaining portion 146 is defined by a length. Similar to the length of spacing portion 144, the length of retaining portion 146 determines the rolled products which may be received by product arm 140. For example, the length of retaining portion 146 determines a maximum length of a rolled product which may be received by product arm 140. Retaining portion 146 is also determined by a diameter. The diameter of retaining portion 146 also determines the rolled products which may be received by product arm 140. Rolled products may be defined by an inside diameter through which retaining portion 146 may be inserted. Only products having an inside diameter greater than the diameter of retaining portion 146 may be received by product arm 140.

As shown in FIG. 1, retaining portion 146 includes a protrusion (e.g., projection, protuberance, etc.), shown as end stop 148. End stop 148 is configured to prevent a rolled product from sliding off of retaining portion 146. In this way, end stop 148 allows rolled product dispenser 100 to be operated reliably by a user. End stop 148 includes an angled portion and a protuberance portion. For example, as shown in FIG. 1, end stop 148 is angled from retaining portion 146 and includes a spherically-shaped protuberance. In this example, the angled portion of end stop 148 cooperates with the protuberance to retain a rolled product on product arm 140. The protuberance of end stop 148 may be of various shapes and sizes. For example, end stop 148 may include a plate like protuberance. In some examples, end stop 148 may not include an angled portion or a protuberance. In some alternative examples, end stop 148 includes a security feature to prevent the rolled product from being removed without authorization. For example, end stop 148 may be a plate that secures the rolled product on product arm 140 such that the rolled product cannot be removed from product arm 140 without the use of a key.

According to various embodiments, retaining channel 150 is integrated within (e.g., integral to, etc.) frame 110. Retaining channel 150 is defined by a width and depth. According to various embodiments, the width and depth of retaining channel 150 is selected such that retaining channel 150 may receive a variety of different mobile devices. For example, a combination of the width and the depth of retaining channel 150 may allow a user to place a smartphone in retaining channel 150 such that the smartphone is propped upright. The width and depth of retaining channel 150 may be determined based on an average width and depth of a plurality of smartphones (e.g., smartphones of one brand, smartphones common in one region, etc.). Similarly, retaining channel 150 may have a width and depth that account for a smartphone case. Retaining channel 150 is also defined by a length.

As shown in FIGS. 1 and 2, the length of retaining channel 150 is equal to a length of frame 110 so that retaining channel 150 extends along frame 110. However, different lengths of retaining channel 150 may also be used. For example, retaining channel 150 may only extend along part of the length of frame 110. In some alternative embodiments, retaining channel 150 is configured to couple to a smartphone. For example, a specialized smartphone case may include retaining features configured to selectively mate with receiving features on retaining channel 150, thereby securing the mobile phone to retaining channel 150. Following such an example, the connection between the specialized smartphone case and retaining channel 150 may provide electrical charging to the smartphone. Alternatively, retaining channel 150 may provide inductive charging to a smartphone. In some alternative embodiments, rolled product dispenser 100 does not include retaining channel 150. As shown in FIG. 2, a wall of retaining channel 150, shown as back wall 210, is sloped or otherwise angled towards the wall to which rolled product dispenser 100 is mounted causing the mobile device to achieve an angled or sloped position within retaining channel 150. Through the angled or sloped position of the mobile device in retaining channel 150, the force of gravity may bias the mobile phone against back wall 210. In other words, back wall 210 is configured to maintain an upright position of a mobile device. According to various embodiments, back wall 210 is designed to support any object placed in retaining channel 150 that is in contact with back wall 210. In this way, back wall 210 may prevent objects from slipping or tipping out of retaining channel 150.

Bottom surface 160 may be covered by an applied anti-slip or non-slip product, coating, etching, or other suitable treatment to prevent a user's smartphone from slipping or otherwise moving in retaining channel 150. For example, bottom surface 160 may be treated with a rubberized coating. Similarly, bottom surface 160 may be covered by an anti-slip tape. Bottom surface 160 may be knurled or otherwise imprinted and etched to provide an anti-slip surface. According to various embodiments, bottom surface 160 is configured to be parallel with the floor. However, in other embodiments, bottom surface 160 is angled to or away from the wall. In an alternative embodiment, bottom surface 160 has a stepped surface configured to receive items of various widths such as smartphones. Each stop may be formed according to a popular mobile phone width. Bottom surface 160 may extend along only part of retaining channel 150.

According to various embodiments, light 170 is configured to illuminate a target (e.g., desired, etc.) location. For example, in some embodiments, light 170 is configured to illuminate auxiliary dispenser 120 and/or product arm 140. Light 170 may be various sources of illumination. According to some embodiments, light 170 is a light emitting diode (LED). Light 170 may be selectively repositionable by the user between any number of locations. For example, light 170 may be able to selectively rotate between a number of angular positions. In some embodiments, light 170 is selectively repositionable such that light from light 170 illuminates product arm 140, auxiliary dispenser 120, and/or the user. Similarly, light 170 may be selectively operated by a user between several modes. For example, light 170 may have an "on" mode, where light 170 is illuminated at seventy percent of maximum output, an "off" mode, where light 170 is not illuminated, a "low" mode, where light 170 is illuminated at thirty percent of maximum output, and a "high" mode, where light 170 is illuminated at one-hundred percent of maximum output. Light 170 may be powered by an alternating current plug connection (e.g., a wall outlet, etc.), a battery, or a capacitor. Light 170 may be coupled to an energy generation or energy harvesting mechanism configured to provide electrical power to a capacitor electrically coupled to light 170. In one example, light 170 is coupled to a photovoltaic array.

According to some embodiments, rolled product dispenser 100 further includes a sensor (e.g., illumination sensor, photosensor, etc.) configured to detect an amount of light in an area surrounding rolled product dispenser 100. The sensor may be coupled to light 170 and configured to control an output of light 170. In various embodiments, the sensor is configured to turn on light 170 when a level or light in an environment is below a threshold. Similarly, the sensor may be configured to continuously vary the light produced by light 170. Light 170 may also include a lens (e.g., refractor lens, magnifying lens, etc.). Light 170 may be illuminated a variety of different colors. For example, light 170 may be selectively operable between a first color (e.g., clear), a second color (e.g., red), and a third color (e.g., blue). In some applications, light 170 is a low-powered emergency light. Light 170 may be configured to provide informational context to a user. For example, during an emergency light 170 may operate according to a specified pattern corresponding to the emergency. Similarly, the sensor may be a motion sensor. In these applications, the motion sensor may turn on light 170 in response to a detected motion such as the user approaching rolled product dispenser 100.

According to various embodiments, rolled product dispenser 100 is configured to replace an existing rolled product dispenser (e.g., toilet paper dispenser, etc.). However, in an alternative embodiment, rolled product dispenser 100 is configured to compliment an existing rolled product dispenser. For example, rolled product dispenser 100 may not include product arm 140 and instead utilize the existing rolled product dispenser. In this way, the user need not uninstall the existing rolled product dispenser. In these applications, product arm 140 is removed from rolled product dispenser 100. The user may also decide to uninstall the existing rolled product dispenser and reinstall product arm 140. The existing rolled product dispenser may be a theft-resistant spindle, a vandal-resistant spindle, a toilet paper holder (e.g., hook, etc.), a single roll dispenser, a double roll dispenser, a three roll dispenser, a jumbo-roll dispenser, a twin jumbo-roll dispenser, a recessed dispenser, a surface mounted dispenser with hood, a spindle including an air freshener, or any other similar rolled product dispenser. Additionally, rolled product dispenser 100 may be installed alongside the existing rolled product dispenser, thus providing the user with the option of having two rolled products available simultaneously.

In various applications, rolled product dispenser 100 is installed in a bathroom (e.g., washroom, restroom, outhouse, etc.). Accordingly, rolled product dispenser 100 may be installed proximate a toilet, bidet, urinal, latrine, bathtub, shower, spa, hot tub, Jacuzzi, or other bathroom device. In a commercial setting, rolled product dispenser 100 may be installed in a bathroom stall. Rolled product dispenser 100 may be installed in restrooms on aircraft, naval vessels, and in portable toilets.

Figure 3:
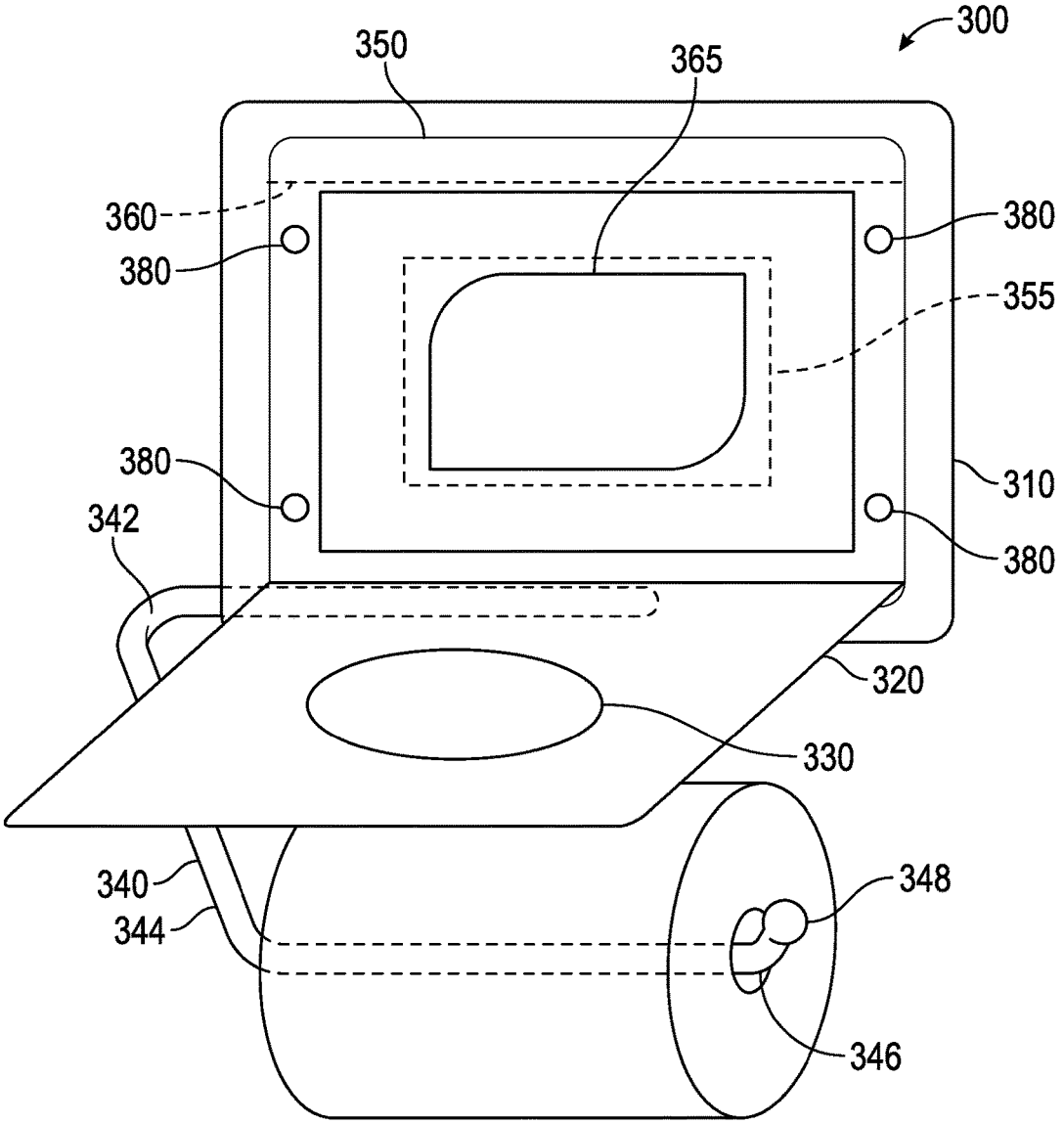
FIG. 3 is a front perspective view of another rolled product dispenser, according to an exemplary embodiment.
Figure 4:
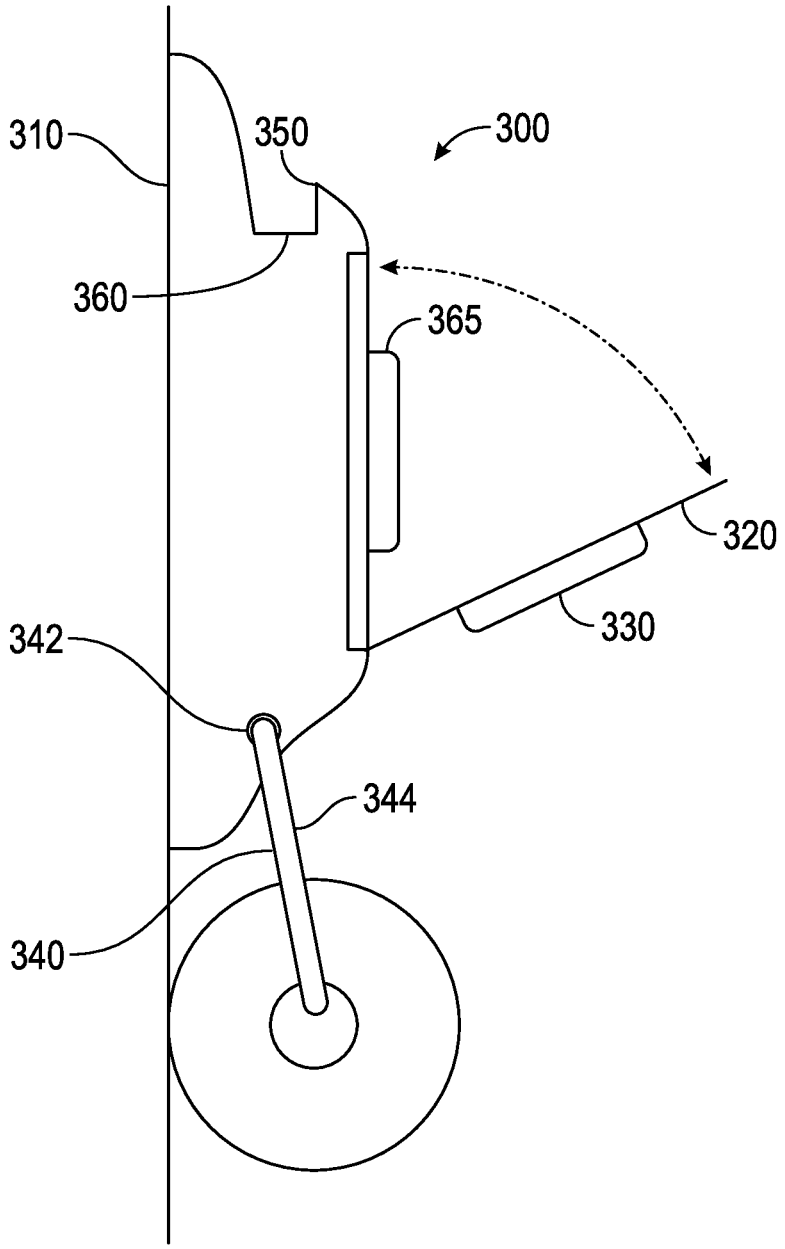
FIG. 4 is a side view of the rolled product dispenser shown in FIG. 3.
Figure 5:
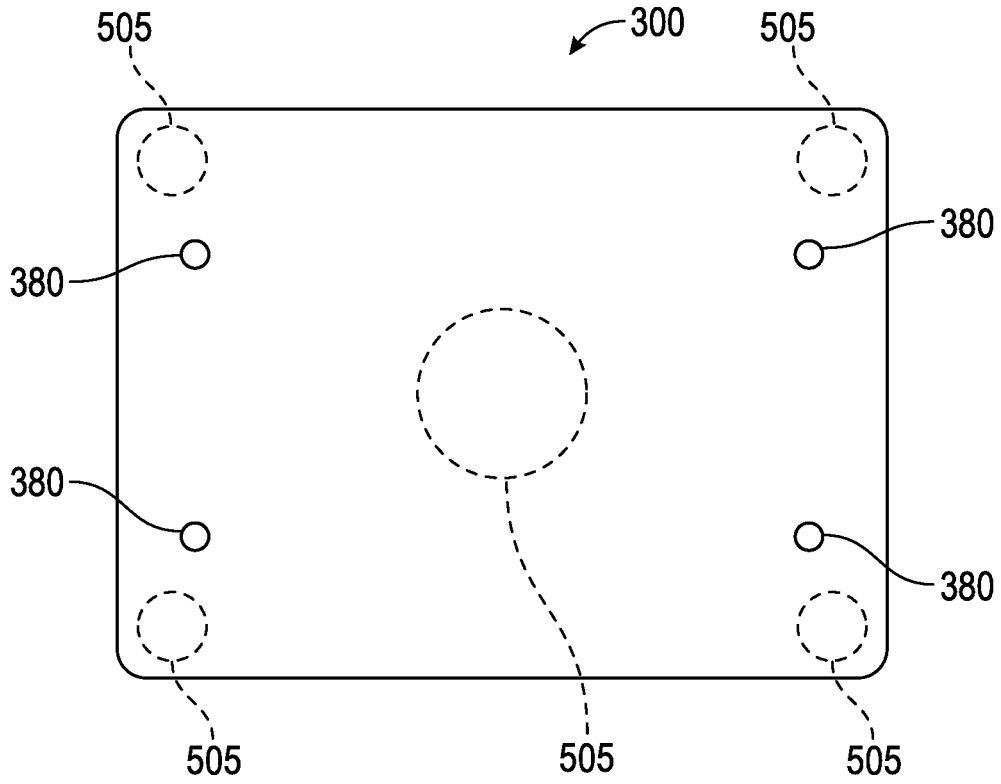
FIG. 5 is a rear view of the rolled product dispenser shown in FIG. 3.

Referring now to FIGS. 3-5, a dispenser, shown as rolled product dispenser 300, is shown. Rolled product dispenser 300 includes a frame, shown as frame 310. Frame 310 is configured to secure rolled product dispenser 300 to a wall (e.g., mounting surface, etc.). Frame 310 includes a dispenser, shown as auxiliary dispenser 320. Auxiliary dispenser 320 is configured to dispense a secondary product to a user such that rolled product dispenser may provide the user with multiple products simultaneously. Auxiliary dispenser 320 includes an opening, shown as opening 330. A user may access the secondary product in auxiliary dispenser 320 via opening 330. According to various embodiments, auxiliary dispenser 320 is operable between a closed position, where the secondary product may be taken from auxiliary dispenser 320 by a user, and an open position, where the secondary product is loaded into auxiliary dispenser 320. As shown in FIGS. 3-4, auxiliary dispenser 320 is not in the closed position. In one embodiment, FIG. 4 illustrates auxiliary dispenser 320 in the open position.

Like rolled product dispenser 100, rolled product dispenser 300 includes a rolled product holder (e.g., bar, hook, prong, etc.), shown as product arm 340. Product arm 340 is configured to support and dispense a rolled product. Product arm 340 includes a first portion, shown as adaptor portion 342, a second portion, shown as spacing portion 344, and a third portion, shown as retaining portion 346. Adaptor portion 342 is configured to secure product arm 340 to frame 310. Spacing portion 344 is configured to facilitate a target distance between frame 310 and the rolled product on product arm 340. Retaining portion 346 is configured to receive and retain the rolled product on product arm 340. Retaining portion 346 may include a protrusion, shown as end stop 348. End stop 348 may retain a rolled product on product arm 340.

Rolled product dispenser 300 also includes a channel (e.g., canal, slot, tray, etc.), shown as retaining channel 350. Retaining channel 350 may function and be structured similarly to retaining channel 150. According to various embodiments, retaining channel 350 is configured to receive a device (e.g., mobile device, smartphone, tablet, etc.) or other object or possession (e.g., purse, clutch, etc.) of a user. Retaining channel 350 includes a surface (e.g., face, etc.), shown as bottom surface 360. Bottom surface 360 is configured to prevent motion and movement of objects placed in retaining channel 350. For example, bottom surface 360 may include an anti-microbial gel pad or similar material intended to maintain a position of a user's electronic device in retaining channel 350 if rolled product dispenser 300 is bumped.

Rolled product dispenser 300 also includes a compartment (e.g., zone, void, etc.), shown as receiving bay 355. Much like receiving bay 200 of rolled product dispenser 100, receiving bay 355 is configured to receive a secondary product for dispensing from auxiliary dispenser 320. Receiving bay 355 is accessible through an opening (e.g., access, portal, etc.), shown as opening 365. In application, secondary product is extracted from receiving bay 355 through opening 365 and then through opening 330. In this way, opening 365 provides an additional layer of security and restraint, thereby ensuring that the secondary product stays in rolled product dispenser 300. According to various embodiments, opening 365 is similar to opening 330. In some embodiments, rolled product dispenser 300 may not include opening 365 in that receiving bay 355 is directly exposed across all of auxiliary dispenser 320.

Rolled product dispenser 300 includes at least one hole, shown as mounting holes 380, in frame 310. Mounting holes 380 may cooperate with a fastener (e.g., fastening connection, bolt, screw, post, etc.) to secure rolled product dispenser 300 to a mounting surface (e.g., wall, panel, stud, shelf, tile, etc.). In some examples, mounting holes 380 are threaded and configured to receive threaded fasteners. In these examples, mounting holes 380 may be pre-formed (e.g., pre-drilled, pre-threaded, etc.). In other examples, mounting holes 380 are indicative of regions where fasteners are inserted into frame 310. In these examples, mounting holes 380 may receive a threaded pattern from a fastener. Further, mounting holes 380 may be through-holes in which a user can access a fastener that is used to secure rolled product dispenser 300 to the mounting surface by inserting a tool (e.g., screw driver, nut driver, etc.) into mounting holes 380. In these examples, mounting holes 380 may be covered with covering panels such as plugs, threaded covers, security covers, and other suitable covering panels such that the appearance and function of mounting holes 380 is generally hidden. In alternative embodiments, rolled product dispenser 300 is mounted to a mounting surface additionally or alternatively through a magnetic interaction with the mounting surface. In these examples, mounting holes 380 may contain magnets.

According to one alternative embodiment, secondary product may be removed through opening 330 at a first rate and removed through opening 365 at a second rate faster than the first rate. Similarly, in another alternative embodiment, opening 330 may facilitate removal of only a first amount of secondary product from auxiliary dispenser 320 while opening 365 facilitates removal of a second amount of secondary product, larger than the first amount. In this way, the user can selectively dispense secondary product from auxiliary dispenser 320. According to yet another alternative embodiment, auxiliary dispenser 320 is removed from rolled product dispenser 300 such that secondary product is dispensed directly from opening 365.

As shown in FIG. 5, rolled product dispenser 300 further includes a number of locations, shown as adhesive tab locations 505. According to various embodiments, adhesive tab locations 505 indicate regions where a plurality of adhesive tabs and/or fasteners are mounted to frame 310. The adhesive tabs can be used in conjunction with fasteners in mounting holes 380 to couple rolled product dispenser 300 to a mounting surface. In some examples, the adhesive tabs and/or fasteners in adhesive tab locations 505 are circular and/or arranged in a circular group. In other examples, the adhesive tabs and/or fasteners in adhesive tab locations 505 are rectangular and/or arranged in a rectangular group. Additional or fewer adhesive tab locations 505 may be included in rolled product dispenser 300 such that rolled product dispenser 300 may be tailored for a target application.

Figure 6:
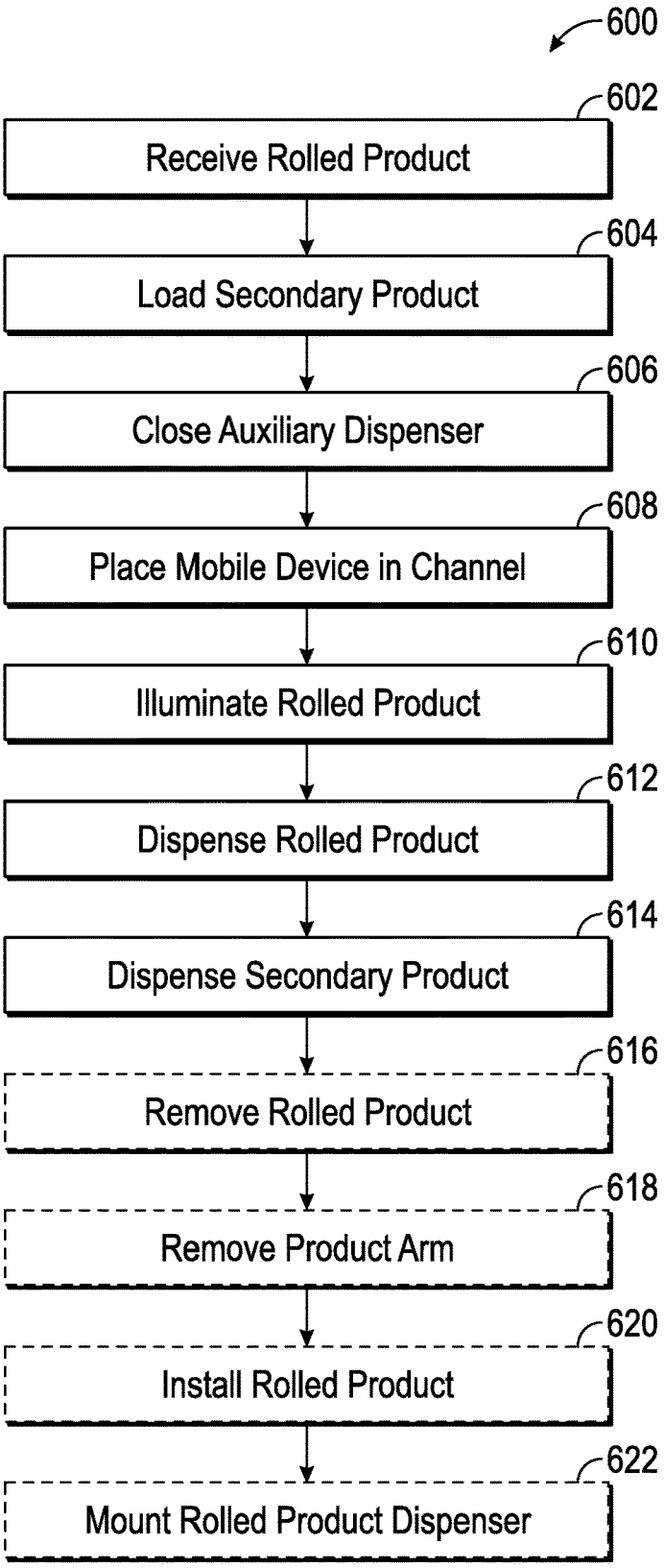
FIG. 6 is a flow diagram of a dispensing process for a rolled product dispenser, according to an exemplary embodiment.

Referring to FIG. 6, dispensing process 600 is described in detail. Dispensing process 600 begins with step 602, receiving rolled product on a product arm (e.g., product arm 140, product arm 340, etc.). For example, a user may place a roll of toilet paper on the product arm. At step 604, secondary product is loaded into an auxiliary dispenser (e.g., auxiliary dispenser 120, auxiliary dispenser 320, etc.). For example, the user may load wet wipes into the auxiliary dispenser. At step 606, the auxiliary dispenser is closed. For example, after loading the auxiliary dispenser with wet wipes, the user closes the auxiliary dispenser. At step 608, a mobile device (e.g., smartphone, tablet, etc.) of the user is placed in a channel (e.g., retaining channel 150, etc.). For example, the user may place the user's cellphone in the channel. At step 610, the rolled product is illuminated by a light (e.g., light 170, etc.). For example, the roll of toilet paper on the product arm is illuminated by the light. At step 612, the rolled product is dispensed from the product arm. For example, the user may dispense toilet paper by turning the roll of toilet paper. At step 614, the secondary product is dispensed through an opening (e.g., opening 130, opening 330, etc.) in the auxiliary dispensed. For example, the user may grab wet wipes from the auxiliary dispenser through an opening.

In some applications, dispensing process 600 may include additional steps. At step 616, the rolled product is removed from the product arm. For example, the user may remove the roll of toilet paper from the product arm. At step 618, the product arm may be removed (e.g., detached, disconnected, etc.) from the frame. For example, the user may detach the product arm from the frame by pulling on the product arm and holding the frame still. At step 620, the rolled product may be installed on an existing rolled product dispenser. For example, the user may insert the roll of toilet paper on a toilet paper dispenser that was previously present in the bathroom. At step 622, the user may mount the rolled product dispensing system. For example, the rolled product dispensing system (e.g., rolled product dispenser 100, rolled product dispenser 300, etc.) may be mounted on a wall of the bathroom. In another example, the rolled product dispensing system may be mounted at a location proximate the existing rolled product dispenser.

According to various embodiments, rolled product dispenser 100 and/or rolled product dispenser 300 are used to receive, hold (e.g., support, etc.), and dispense rolled products. Rolled products may include toilet tissue (e.g., toilet paper, etc.), tissue (e.g., Kleenex®, etc.), paper towels (e.g., shop towels, etc.), foils (e.g., aluminum foil, tin foil, etc.), wraps (e.g., Saran™ wrap, cellophane wrap, plastic wrap, etc.), and other suitable products including any other rolled paper products. According to various embodiments, rolled product dispenser 100 and rolled product dispenser 300 are configured to receive an approximately ten centimeter wide roll of toilet paper having an outside diameter of twelve centimeters and inside diameter of approximately four centimeters.

In some embodiments, rolled product dispenser 100 and/or rolled product dispenser 300 further includes a speaker. The speaker may be configured to provide an audible alert to a user. For example, the speaker may be connected to an intercom of a store. Similarly, the speaker may be configured to play music or other audio files. It is understood that rolled product dispenser 100 and rolled product dispenser 300 may include more or less components than are shown and described and that components described in relation to rolled product dispenser 100 may be implemented in rolled product dispenser 300 and that components described in relation to rolled product dispenser 300 may be implemented in rolled product dispenser 100. For example, rolled product dispenser 100 may not include retaining channel 150, and thereby bottom surface 160, or light 170. For example, rolled product dispenser 100 may include mounting holes similar to mounting holes 380 and/or adhesive tab locations similar to adhesive tab locations 505. Further, rolled product dispenser 100 and/or rolled product dispenser 300 may include an air freshener. For example, rolled product dispenser 300 may include an air freshener located on a portion of frame 310.

It should be noted that references to "front," "rear," "upper," "top," "bottom," "base," and "lower" in this description are merely used to identify the various elements as they are oriented in the Figures. These terms are not meant to limit the element which they describe, as the various elements may be oriented differently in various temperature controlled cases.

Further, for purposes of this disclosure, the term "coupled" means the joining of two members directly or indirectly to one another. Such joining may be stationary in nature or moveable in nature and/or such joining may allow for the flow of fluids, electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

It is important to note that the construction and arrangement of the elements of temperature controlled case and the angled discharge diffuser provided herein are illustrative only. Although only a few exemplary embodiments of the present inventions have been described in detail in this disclosure, those skilled in the art who review this disclosure will readily appreciate that many modifications are possible in these embodiments (e.g., the structure of the assist device, the configuration of the first coupling arm and the second coupling arm, etc.) without materially departing from the novel teachings and advantages of the disclosure. Accordingly, all such modifications are intended to be within the scope of the disclosure.

What is claimed:

1. A rolled product dispenser substantially protruding from a surface of a wall, the rolled product dispenser comprising:

a frame configured to be coupled to a wall;

a product arm configured to support and retain a rolled product for dispensing, the product arm coupled to the frame;

an auxiliary dispenser consisting of a single door pivotally coupled to the frame, the single door comprising a first opening and being operable between an open state and a closed state, the auxiliary dispenser configured to dispense a secondary product through the first opening, the auxiliary dispenser further configured to substantially enclose a secondary container, the secondary container comprising a second opening, the secondary product configured to be dispensed through the first opening and the second opening when the single door is in the closed state; and a channel configured to receive a mobile device of a user on a bottom surface of the channel, the channel integrated within the frame;

wherein the first opening is configured to be parallel to the wall with the single door in the closed state and the second opening is configured to be parallel to the first opening.

2. The rolled product dispenser of claim 1, further comprising a plurality of adhesive strips mounted on the frame;

wherein the frame is configured to be mounted to the wall through the use of fasteners and through the use of the plurality of adhesive strips.

3. The rolled product dispenser of claim 2, further comprising a lighting element integrated within the frame;

wherein the lighting element is configured to illuminate at least one of the product arm and the auxiliary dispenser.

4. The rolled product dispenser of claim 3, wherein light from the lighting element may be directed towards a desired location;

wherein the rolled product for dispensing is a conventional roll of toilet paper; and wherein the secondary product is a plurality of wet wipes.

5. The rolled product dispenser of claim 2, wherein the product arm is removably attached to the frame such that the rolled product dispenser may be retrofit into an installation with an existing rolled product dispenser.

6. The rolled product dispenser of claim 1, further comprising an anti-slip insert coupled to the bottom surface of the channel;

wherein the anti-slip insert is configured to prevent unintended movement of the mobile device in the channel.

7. The rolled product dispenser of claim 6, wherein the channel comprises a back wall;

wherein the back wall is angled towards the wall to facilitate upright placement of the mobile device in the channel.

8. The rolled product dispenser of claim 1, wherein the secondary product may be loaded into the auxiliary dispenser when the single door is in the open state.

9. A system for dispensing toilet paper and wipes from a secondary container comprising a second opening in a bathroom, the system comprising:

a frame configured to be coupled to a wall of a bathroom via a fastener connection with the wall;

a product arm configured to receive toilet paper and facilitate dispensing of the toilet paper, the product arm coupled to the frame; and an auxiliary dispenser comprising a door rotatably coupled to the frame, the door comprising an uncovered opening, the uncovered opening defined by a constant cross-sectional shape extending entirely through the door, the auxiliary dispenser configured to dispense wipes from the secondary container through the uncovered opening when the door is in the closed position and when the door is in the open position;

wherein the door is operable between an open position and a closed position;

wherein the uncovered opening is parallel to the wall when the door is in the closed position;

wherein the secondary container can be loaded into a receiving bay when the door is in the open position;

wherein the secondary container is substantially enclosed by the auxiliary dispenser when the door is in the closed position; and wherein the wipes can be dispensed from the receiving bay through the uncovered opening and the second opening by a user when the auxiliary dispenser is in the closed position.

10. The system for dispensing toilet paper and wipes of claim 9, further comprising:

a channel configured to receive a mobile device of the user on a bottom surface of the channel, the channel integrated within the frame and configured to extend along a top surface of the frame; and a non-slip insert covering the bottom surface of the channel;

wherein the channel comprises a back wall; and wherein the back wall is angled towards the wall such that the mobile device is biased against the back wall by the force of gravity.

11. The system for dispensing toilet paper and wipes of claim 10, further comprising a plurality of adhesive strips mounted on the frame;

wherein the frame is configured to be coupled to the wall through the use of the plurality of adhesive strips in addition to through the use of the fastener connection.

12. The system for dispensing toilet paper and wipes of claim 11, further comprising a light source structurally integrated within the frame.

13. The system for dispensing toilet paper and wipes of claim 12, wherein the light source is configured to be turned on when a level of light proximate the light source is below a threshold.

14. The system for dispensing toilet paper and wipes of claim 13, wherein the product arm is removably attached to the frame; and wherein the product arm is removed from the frame when an existing toilet paper dispenser is present in the bathroom.

15. A method for manufacturing a rolled product dispenser, the method comprising:

constructing a frame;

forming a receiving channel in the frame, the receiving channel configured to receive a mobile device;

coupling a product arm to the frame, the product arm configured to receive a rolled product;

forming a receiving bay in the frame;

inserting an auxiliary dispenser into the receiving bay, the auxiliary dispenser comprising a door;

inserting a secondary container into the auxiliary dispenser;

pivotally coupling the door to the frame, the door comprising a first opening defined by a constant cross-sectional shape extending entirely through the door and being operable between an open state and a closed state, the door substantially enclosing the secondary container when in the closed state and when the secondary container is inserted into the auxiliary dispenser; and inserting a light into the frame, the light configured to illuminate the rolled product;

wherein the frame is configured to be coupled to a wall such that the opening is substantially parallel to the wall when the auxiliary dispenser is inserted into the receiving bay and the door is in the closed state.

16. The method for manufacturing a rolled product dispenser of claim 15, further comprising:

covering a bottom surface of the receiving channel in a non-slip material;

wherein the non-slip material is configured to prevent unintended movement of the mobile device in the receiving channel.

17. The method for manufacturing a rolled product dispenser of claim 16, further comprising:

attaching a number of adhesive strips to the frame; and providing a number of fastener connections on the frame;

wherein the frame is configured to be coupled to a wall through the use of the number of adhesive strips and the number of fastener connections.

18. The method for manufacturing a rolled product dispenser of claim 17, wherein the rolled product is toilet paper; and wherein the secondary product is wet wipes.

19. The method for manufacturing a rolled product dispenser of claim 18, further comprising:

forming the first opening in the door;

wherein the first opening is configured to receive and dispense the secondary product.

20. The method for manufacturing a rolled product dispenser of claim 19, further comprising:

angling a back wall of the retaining channel towards the wall such that the back wall is configured to provide a supporting force to the mobile device.

* * * * *